United States Patent [19]

James

[11] 4,182,075

[45] Jan. 8, 1980

[54] CAP-FIRING ARM FOR A TOY FIGURE

[75] Inventor: David F. James, Redondo Beach, Calif.

[73] Assignee: Mattel, Inc., Hawthorne, Calif.

[21] Appl. No.: 875,436

[22] Filed: Feb. 6, 1978

[51] Int. Cl.[2] ..... A63H 5/00

[52] U.S. Cl. ..... 46/118; 46/176; 272/27 R

[58] Field of Search ..... 46/118, 119, 161, 142, 46/143, 145, 148, 175 R, 176, 196, 98, 117, 1 E; 272/27 R, 27 N

[56] References Cited

U.S. PATENT DOCUMENTS

| | | | |
|---|---|---|---|
| 3,082,573 | 3/1963 | Kantz | 46/176 X |
| 3,448,541 | 6/1969 | Barlow | 46/176 X |
| 3,699,713 | 10/1972 | Sapkus et al. | 46/119 |
| 3,978,611 | 9/1976 | Strongin | 46/118 |
| 3,986,295 | 10/1976 | Keller | 46/119 |

FOREIGN PATENT DOCUMENTS

| | | | |
|---|---|---|---|
| 735403 | 8/1955 | United Kingdom | 46/118 |

*Primary Examiner*—Louis G. Mancene
*Assistant Examiner*—Mickey Yu
*Attorney, Agent, or Firm*—John G. Mesaros; Max E. Shirk; Ronald M. Goldman

[57] ABSTRACT

A cap-firing arm for a toy figure, the arm being frictionally secured for rotation at the shoulder of the figure by a hollow hub having a pinion gear internally of the figure. The arm is hollow and includes a spring-loaded hammer member slidably mounted therein with a cocking pin extending outwardly through a slot in the lower portion of the arm. The hammer member includes a firing pin adapted for coacting with an anvil secured within a hand mounting member which is slidable for loading the cap. The hammer member includes a tear drop shaped lobe extending through a similarly configured aperture adjacent to the shoulder portion and an actuating rod extending through the hollow hub disengages the lobe upon depression of a back plate of the figure which simultaneously elevates the arm to a horizontal position whereupon the cap is fired.

14 Claims, 8 Drawing Figures

CAP-FIRING ARM FOR A TOY FIGURE

BACKGROUND OF THE INVENTION

The background of the invention will be discussed in two parts:

1. Field of the Invention

This invention relates to animated toy figures, and more particularly to an appendage such as an arm of the figure having a cap-firing mechanism mounted in the interior thereof.

2. Description of the Prior Art

Toy figures are very popular with children, and especially toy figures having animation. One such toy figure which provides animation by depression on a plate which comprises a portion of the rear wall of the doll torso is shown and described in U.S. Pat. No. 3,699,713, such patent being assigned to the assignee of the instant invention. In this particular patent, the device generally includes a doll torso having a portion of the rear wall thereof in the form of a plate carrying a sector gear or rack whih coacts with a pinion on a hub to which is mounted the arm of the doll. Depression of the plate rotates the arm in the form of a karate chop.

Another figure toy having animation in the form of movable appendages is shown and described in U.S. Pat. No. 3,978,611, in which the toy figure has a pistol mounted in one hand, the piston being positioned in a holster, and upon operation of a lever, the pistol is withdrawn from the holster and extended to a firing position. Mechanism within the torso of the doll provides a noise simulating the firing of the pistol, the noise being generated substantially concurrently with the pistol obtaining the firing position.

Another such animated feature of a toy figure is shown and described in U.S. Pat. No. 3,986,295, such patent being assigned to the assignee of the instant invention. The device of this patent includes a gauntlet of a sleevelike nature surrounding the arm and being operated by a spring-loaded rod to an extended position upon depression of a plate formed as part of the back of the torso.

Such toy figures provide animation and amusement for a child.

Accordingly, it is an object of the resent invention to provide a new and improved animated toy figure.

It is another object of this invention to provide a new and improved cap-firing arm for a toy figure.

It is still another object of this invention to provide a new and improved cap-firing mechanism mountable within an arm of a toy figure.

SUMMARY OF THE INVENTION

The foregoing and other objects of the invention are accomplished by providing a toy figure having a hollow arm rotatably mounted thereto, the arm being mounted by frictional engagement with a hollow hub having a pinion portion internally of the upper torso of the doll. An actuating rod extends through the hollow portion of the hub. A plate is provided on the rear of the upper torso of the doll, the plate including a rack or sector gear in coacting engagement with the pinion for effecting rotation of the arm upon depression of the plate. In proximity to the sector gear portion, the plate includes a cam or ramp portion coacting with the actuating rod for axially displacing the rod toward the interior of the hollow arm. Contained within the arm is a cylinder or barrel having a closed end at the upper portion thereof, the closed end having a tear drop shaped aperture formed therein. A hammer member is slidably mounted within the barrel, the hammer member having a shaft portion terminated at the free end thereof in a tear drop shaped lobe configured for passage through the aperture, the lobe being engageable by the actuating rod. A spring normally biases the hammer member toward the wrist of the arm. The hammer member includes a firing pin with a transversely extending hammer cocking pin extending out through a slot formed in the arm, the slot having an offset portion at the uppermost part thereof, the position thereof generally coinciding with the lobe passing through the aperture with slight rotation of the cocking pin displacing the lobe relative to the aperture to maintain the hammer member in its uppermost position against the force of the spring. A cap retaining member is lockably slidably mounted within the lower portion of the arm with the hand secured to one end thereof. The cap retaining member includes an anvil therein in general alignment with the firing pin. For operation, the cap retaining member is extended downwardly, the cap is loaded onto the anvil, the hammer cocking pin is urged against the force of the spring into its locked position, the cap retaining member is then locked in position within the arm, the plate is then depressed to rotate the arm to a firing position and displace the actuating rod to thereby release the hammer member and thereby fire the cap.

Other objects, features and advantages of the invention will become apparent upon a reading of the specification when taken in conjunction with the drawings in which like reference numerals refer to like elements in the several views.

DESCRIPTION OF THE PREFERRED EMBODIMENT

Figure 3:
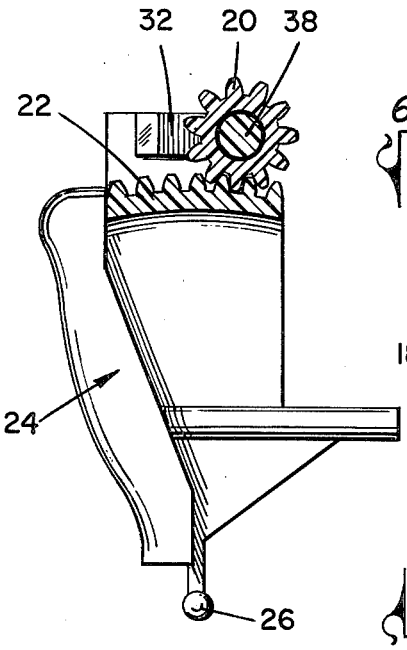
FIG. 3 is a partial end view as viewed along line 3—3 of FIG. 1.
Figure 1:
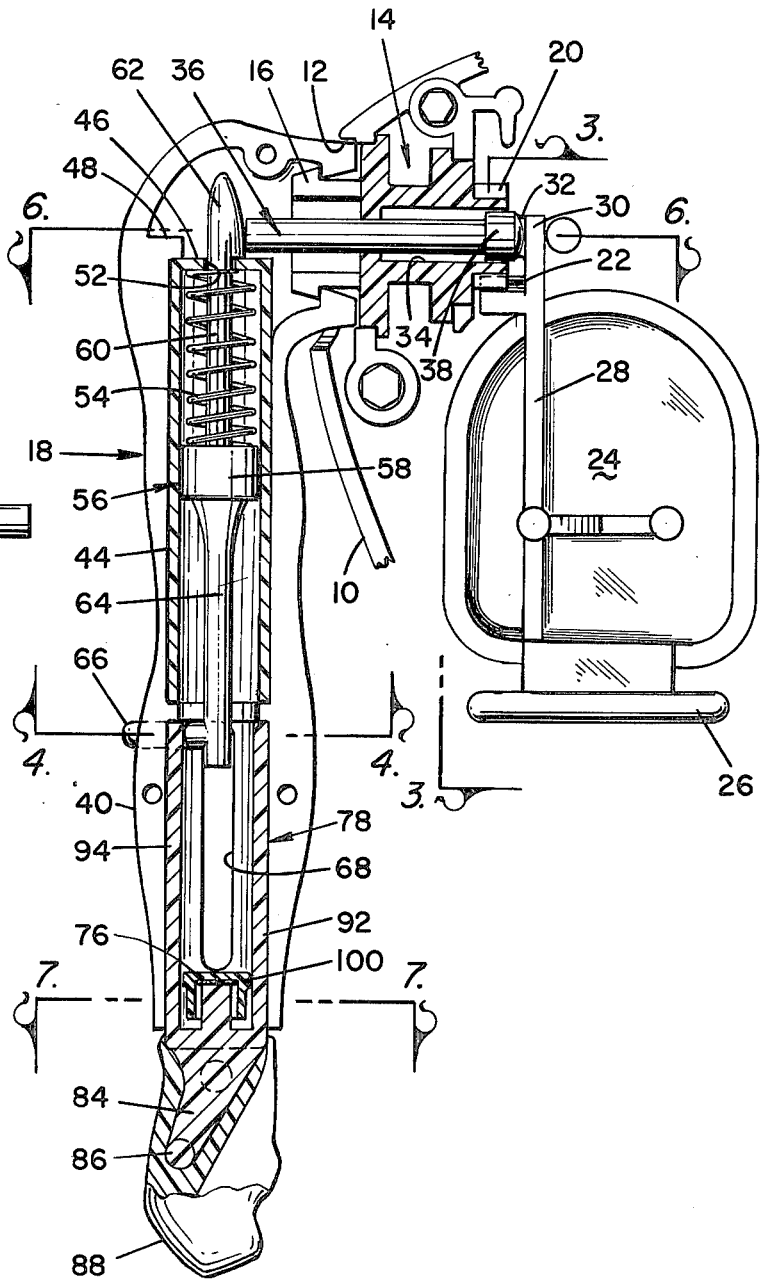
FIG. 1 is a cross sectional front view of a portion of the torso and the arm of the toy figure illustrating the cap-firing mechanism.
Figure 2:
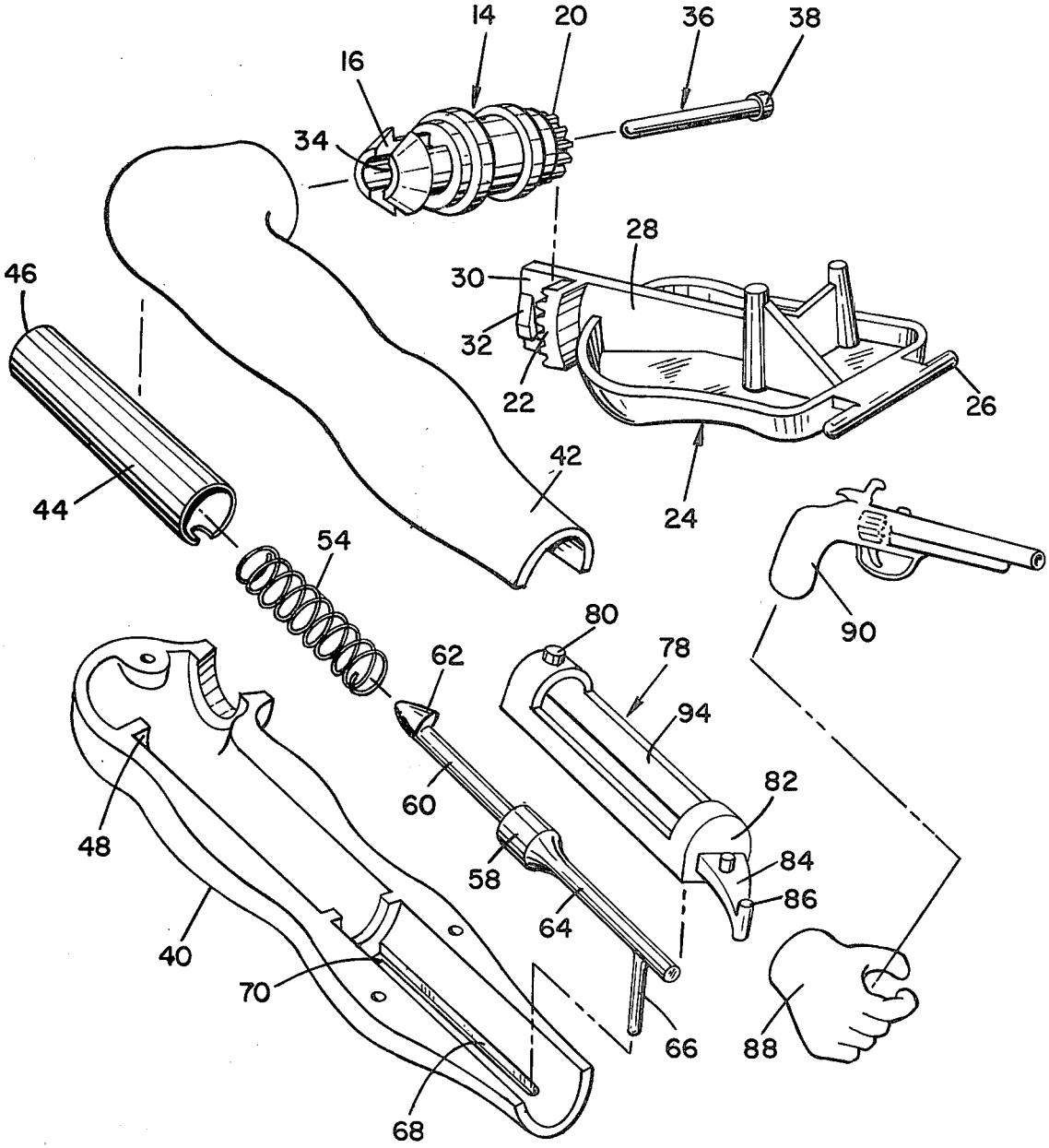
FIG. 2 is an exploded perspective view of the cap-firing arm of the toy figure according to the invention.

Referring now to the drawings and particularly to FIGS. 1 and 2, there is shown a portion of a doll torso 10 having an opening 12 adjacent the shoulder portion thereof. Rotatably mounted within the torso 10 is a hub member generally designated 14 having a cap portion 16 extending out through opending 12 for frictionally engaging the shoulder portion of a hollow arm generally designated 18. Extending inwardly, the hub member 14 includes a pinion 20 adapted for mating engagement with a sector gear portion 22 formed integrally with a plate 24 hingedly coupled about pivot pin 26 to the doll torso 10. The plate 24 is formed as a continuing portion of the rear or back of the torso 10 and is of the type utilized in the device of U.S. Pat. No. 3,699,713, hereinabove described. The plate 24 has integrally formed wall portions 28, one end of which includes the sector gear 22 with an upwardly extending portion 30 having a cam or ramp portion 32 formed therein.

The hub member 14 is generally hollow and provided with an axially extending opening having an enlarged portion 34 with an actuating rod 36 extending therethrough, the actuating rod 36 having an enlarged cap portion 38 slidably received within the enlarged portion 34 for axial displacement therein. The cap portion 38 of actuating rod 36 is normally in abutting relation with the projection 30 of the wall portion 28 of plate 24 with the cam member 32 adapted to engage the cap end 38 during pivoting of the plate 24 to thereby displace the actuating rod 36 axially to the left as viewed in FIG. 1.

As better illustrated in FIG. 2, the arm 18 is formed of two half shells 40 and 42, the interior thereof being suitably molded for retaining therein in the upper portion thereof a barrel member 44 having a closed end 46, the barrel member 44 being retained by means of suitable ridges 48 and 50 formed on the interior of the half shells 40 and 42. The closed end 46 of barrel member 44 is provided with a tear drop shaped aperture 52. A coil compression spring 54 is received within the barrel 44 with one end thereof abutting against the interior of the closed end 46. A hammer member generally designated 56 is provided with an enlarged central body portion 58 having an outer diameter slightly smaller than the inner diameter of barrel 44 for slidable movement therein. Extending upwardly from the enlarged body portion 58 and centrally with respect thereto is a smaller diameter shaft or rod portion 60 having the free end thereof terminating in an enlarged generally tear drop shaped lobe 62 having a configuration in cross section slightly smaller than the aperture 52 for passage therethrough. In the operative position one end of spring 54 abuts against the closed end 46 of barrel 44 with the other end of spring 54 abutting against the adjacent surface of the enlarged body portion 58.

Figure 8:
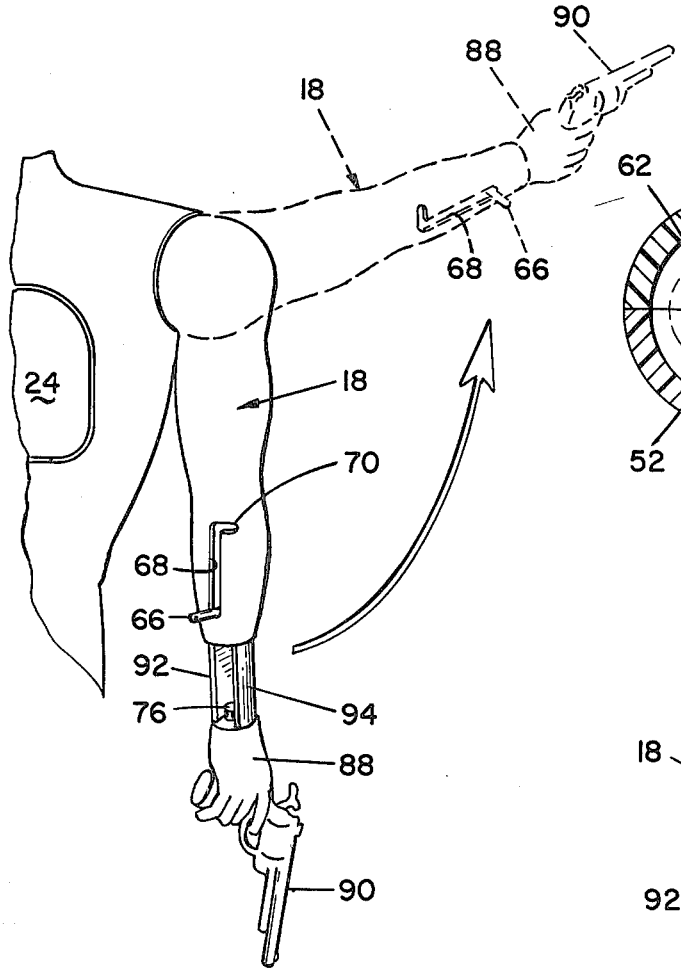
FIG. 8 is a perspective view illustrating the cap-firing arm in its cap-loading condition and its firing position.
Figure 7:
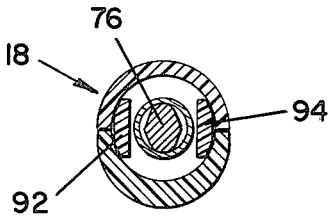
FIG. 7 is a cross sectional view taken generally along line 7—7 of FIG. 1.

Depending downwardly from the enlarged body portion 58, the hammer member 56 includes a rod-shaped firing pin 64 extending generally along the axis of barrel 44. A hammer cocking pin 66 is formed integrally with the firing pin portion 64 of hammer member 56, the cocking pin 66 extending outwardly through a slot 68 formed in the forearm of shell half 40 of arm 18. As best illustrated in FIGS. 2 and 8, the slot 68 is generally linear in a direction parallel to the longitudinal center line of arm 18, the slot 68 terminating in an offset portion 70 adjacent the upper end thereof. In operation, the offset portion 70 acts to lock the hammer cocking pin 66 in the uppermost position, with the firing mechanism parts in the position illustrated in FIG. 1.

As shown in FIG. 1, the hammer cocking pin 66 is in its uppermost position locked into offset portion 70 of slot 68 with the hammer member 56 urging against the force of the coil spring 54. During the upward movement of the hammer cocking pin 66, the lobe 62 is aligned with the tear drop shaped aperture 52 in the closed end 46 of the barrel member 44. As the hammer cocking pin 66 is rotated into the offset portion 70 for locking purposes, the configuration and dimensioning of hammer member 56 permits the lobe 62 to be rotated in the same direction to thereby abut against the adjacent surface of closed end 46, thereby retaining the hammer member 56 in its cocked position.

Figure 6:
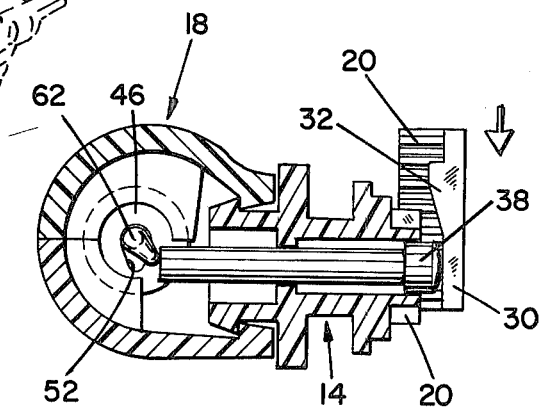
FIG. 6 is a partly diagramatic cross sectional view taken generally along line 6—6 of FIG. 1.

By reference to FIG. 6, the relative position of lobe 62 with respect to aperture 52 is illustrated with the pointed end of lobe 62 generally abutting against the edge of actuating rod 36. As the plate 24 is pressed, the projection 30 of wall portion 28 travels in the direction indicated by the arrow whereupon cam or ramp portion 32 engages the end of cap portion 38 thereby urging actuating rod 36 to the left as viewed in FIG. 6 to urge lobe 62 in a clockwise direction until the outer periphery thereof as viewed in plan view coincides with tear drop shaped aperture 52 thereby permitting hammer member 56 to be released under force of coil spring 54.

Figure 4:
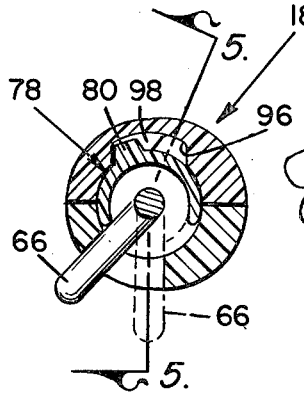
FIG. 4 is a cross sectional view taken generally along line 4—4 of FIG. 1.
Figure 5:
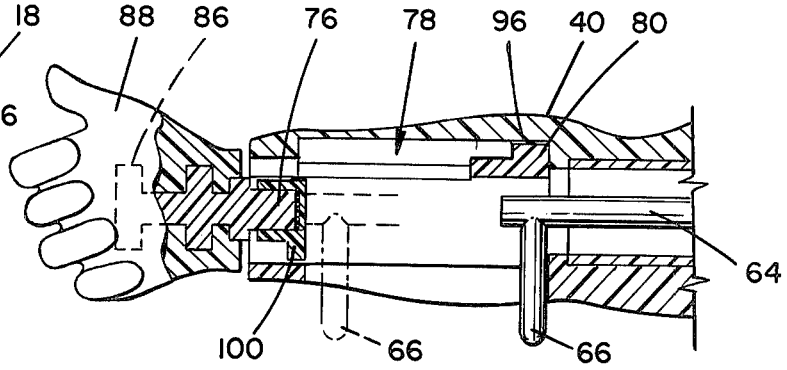
FIG. 5 is a side view of the forearm, partially in cross section and partially broken away as viewed generally along line 5—5 of FIG. 4.

The position of hammer cocking pin 66, as illustrated in FIGS. 4 and 5, is shown in full lines in its "cocked" position, and in dotted lines in its "fired" position.

The firing pin strikes against an anvil 76 which, as shown in FIGS. 1, 2, 5 and 7 is mounted within a cap retaining member 78 slidably and lockably inserted within the forearm of the arm 18. As best illustrated in FIG. 2, the cap retaining member 78 is a semi-cylindrical shell member having a locking lug 80 extending outwardly from the surface adjacent one end thereof with the other end 82 being closed and having a wrist engaging projection 84 with pivot pins 86 at the free end thereof for pivotally engaging mating openings within the hand member 88. The hand member 88 is suitably configured for frictionally receiving therein a simulated toy pistol 90.

The cap retaining member 78 has a cutaway portion to provide a pair of generally opposed bar portions 92 and 94 which, with the cap retaining member 78 mounted in the forearm as depicted in FIG. 8, provide access means for mounting caps onto the anvil member 76. The cap retaining member is slidably mounted within the forearm of the arm 18, and as depicted in FIGS. 4 and 5, the interior of arm 18 is provided with a slot 96 configured for passage therethrough of the locking lugs 80 with an adjacent surface 98 retaining the cap retaining member 78 fully within arm 18 when the member 78 is rotated with lug 80 engaging the surface 98 with locking lug 80 thereby being out of alignment with the slot 96.

In operation, referring particularly to FIG. 8, the arm 18 is positioned to the side as depicted in solid lines. The cap retaining member 78 is then telescoped or slid outwardly of arm 18 by rotating the hand 88 until the locking lug clears the surface 98 into alignment with slot 96, then hand 88 is withdrawn away from arm 18. A cap is then inserted onto the anvil 76. The hammer cocking pin 66 is then moved from its solid line position upwardly within slot 68 until it engages the locking or offset portion 70 to thereby urge the hammer member 56 against the force of its coil spring 54 with lobe 62 being angularly displaced relative to the tear drop shaped opening 52 (see FIGS. 1 and 6) with hammer member 56 being in its "cocked" position.

The back plate 24 is then depressed inwardly of the torso 10 whereupon sector gear 22 engaging pinion 20 causes rotation of the arm 18 counterclockwise as viewed in FIG. 8. During this commencement of rotation, as depicted in FIG. 6, the ramp 32 then contacts the actuating rod 38 which urges against the tip of lobe 62 until lobe 62 is in alignment with the aperture 52, this position generally corresponding to a horizontal or dotted line position as viewed in FIG. 8 of the arm 18. At this position, the rotation of lobe 62 likewise rotates the hammer cocking pin 66 to engage and travel within slot 68 thereby causing the firing pin 64 to strike against a cap 100 (see FIG. 1) mounted on the anvil 76. The cap 100 is generally cup-shaped to fit over the rod-shaped anvil 76, but it is to be understood that flat caps of the perforated strip variety may likewise be utilized in the present invention. In either event, the cap firing sound is generated upon the arm 18 reaching the "firing" or horizontal position.

With the cap-firing mechanism within the arm 18, a toy figure of 9 inches to 12 inches in height can be utilized to fire caps, apparently from a toy pistol 90 of very small dimension. While there has been shown and described a preferred embodiment it is to be understood that various other adaptations and modifications may be made within the spirit and scope of the invention.

What is claimed is:

1. In a toy figure, the combination comprising:

a torso;

a generally hollow arm having a shoulder portion;

means movably mounting said shoulder portion to said torso;

a barrel member within said arm, said barrel member having a generally closed end adjacent said shoulder portion, said closed end having an aperture extending therethrough;

a hammer member slidably mounted for movement within said barrel member, said hammer member having a rod portion configured for extending through said aperture;

spring means within said barrel member coacting with said closed end and with said hammer member for urging said hammer member away from said closed end;

another member mounted within the lower portion of said arm, said another member having anvil means therein for contact by said hammber member;

means for cocking said hammer member against the force of said spring means with said rod portion end extending through said aperture; and means for moving said arm from a first position to a second position and for contacting said rod portion end upon said arm reaching said second position for releasing said hammer member to cause the same to strike said anvil member.

2. In a toy figure, the combination comprising:

a torso;

at least one arm;

means movably mounting said at least one arm on said torso;

a hammer member movably mounted within said one arm;

an anvil member mounted adjacent the hand portion of said one arm for contact by said hammer member;

means normally urging said hammer member toward said anvil member;

means for cocking said hammer member; and means for moving said arm from a first position to a second position and for releasing said cocking means generally upon said arm reaching said second position whereby to cause said hammer member to strike said anvil member.

3. In a toy figure, the combination comprising: a torso; at least one arm; means movably mounting said at least one arm on said torso; a hammer member movably mounted within said one arm; an anvil member mounted adjacent the hand portion of said one arm for contact by said hammer member, said anvil member being; means normally urging said hammer member toward said anvil member; means for cocking said hammer member; and means for moving said arm from a first position to a second position and for releasing said cocking means generally upon said arm reaching said second position whereby to cause said hammer member to strike said anvil member.

4. The combination according to claim 3 wherein said another member and said anvil are configured for retaining caps on said anvil member for striking by said hammer member.

5. The combination according to claim 3 wherein said means for cocking said hammer member includes a slot in said arm and a cocking pin secured to said hammer member, said cocking pin extending through said slot for manual movement.

6. The combination according to claim 5 wherein said slot has an offset portion for retaining said cocking pin.

7. The combination according to claim 6 wherein said hammer member includes a rod portion having the end thereof aconfigured for pivotal displacement by said means for moving said arm with said cocking pin in said offset portion of said slot whereby to release said hammer member.

8. In a toy figure, the combination comprising: a torso; a generally hollow arm having a shoulder position; means movably mounting said shoulder portion to said torso; a barrel member within said arm, said barrel member having a generally closed end adjacent said shoulder portion, said closed end having an aperture extending therethrough; a hammer member slidably mounted for movement within said barrel member, said hammer member having a rod portion configured for extending through said aperture; spring means within said barrel member coacting with said closed end and with said hammer member for urging said hammer member away from said closed end; another member mounted within the lower portion of said arm, said another member having anvil means therein for contact by said hammer member, said another member being a semi-cylindrical member slidably mounted within the lower portion of said arm and said semi-cylindrical member and the interior of said arm being matingly configured to provide locking means to lock said semi-cylindrical member within said arm; means for cocking said hammer member against the force of said spring means with said rod portion end extending through said aperture; and means for moving said arm from a first position to a second position and for contacting said rod portion end upon said arm reaching said second position for releasing said hammer member to cause the same to strike said anvil member.

9. The combination according to claim 8 wherein said semi-cylindrical member is configured to provide access to said anvil member in the extended position and said anvil member is configured for retaining caps thereon for firing upon impact of said hammer member.

10. The combination according to claim 9 wherein said semi-cylindrical member includes other means for retaining a hand member.

11. The combination according to claim 9 wherein said means for cocking said hammer member includes a slot in said arm and a cocking pin secured to said hammer member, said cocking pin extending through said slot for manual movement.

12. The combination according to claim 11 wherein said slot extends generally parallel to the longitudinal center line of said arm and has an offset portion for receiving said cocking pin upon angular displacement thereof.

13. The combination according to claim 11 wherein said aperture in said closed end of said barrel member is tear drop shaped and said rod portion end is configured for passage therethrough, slight rotation of said hammer member causing said rod portion end to abut against the exterior of said closed end whereby to lock said hammer member against the force of said spring means.

14. The combination according to claim 13 wherein said means movably mounting the shoulder portion of said arm to said torso includes a hub member having a central aperture extending therethrough in a direction generally transverse to the direction of said rod portion, and said means for moving said arm includes an actuating rod extending through said central aperture for urging against said rod portion end to rotate said rod portion end into alignment with said tear drop shaped aperture for releasing said hammer member under the force of said spring means.

* * * * *